US006408474B1

(12) United States Patent
Husted et al.

(10) Patent No.: US 6,408,474 B1
(45) Date of Patent: Jun. 25, 2002

(54) PAINT BRUSH WITH TWO COMPONENT BRUSH HANDLE AND METHOD OF MAKING SAME

(75) Inventors: John S. Husted, Dalton; William P. Camp, Jr., Wooster, both of OH (US)

(73) Assignee: The Wooster Brush Company, Wooster, OH (US)

( * ) Notice: Subject to any disclaimer, the term of this patent is extended or adjusted under 35 U.S.C. 154(b) by 0 days.

(21) Appl. No.: 09/373,463

(22) Filed: Aug. 12, 1999

(51) Int. Cl.[7] ..... A46B 15/00; B25G 1/00

(52) U.S. Cl. ..... 15/143.1; 15/193; 15/DIG. 4; 264/243; 16/110.1; 16/902; 300/21

(58) Field of Search ..... 15/190, 191.1, 15/192, 193, 168, 171, 159.1, 160, 143.1, 201, 172, DIG. 4; 264/243; 16/110.1, 430, 902; 300/21

(56) References Cited

U.S. PATENT DOCUMENTS

| | | | | | |
|---|---|---|---|---|---|
| 2,075,570 | A | | 3/1937 | Carpenter | |
| 2,202,292 | A | | 5/1940 | Howard | |
| 2,426,315 | A | | 8/1947 | Marick | |
| 2,664,582 | A | | 1/1954 | Kammann | |
| 2,676,350 | A | * | 4/1954 | Bressler | 15/201 |
| 2,786,222 | A | * | 3/1957 | Rolker | 15/193 |
| 2,840,841 | A | * | 7/1958 | Maxwell | 15/193 |
| 2,854,684 | A | | 10/1958 | Hardman et al. | |
| 3,030,649 | A | * | 4/1962 | Karlan et al. | 15/193 |
| 3,090,063 | A | * | 5/1963 | Weiss et al. | 15/193 |
| 3,112,509 | A | * | 12/1963 | Weiss | 15/193 |
| 3,153,801 | A | * | 10/1964 | Weiss et al. | 15/193 |
| 3,172,141 | A | | 3/1965 | Arena | |
| 3,231,920 | A | * | 2/1966 | Malpus | 15/193 |
| 3,263,259 | A | * | 8/1966 | Shulman | 15/193 |
| 3,757,376 | A | * | 9/1973 | Coombes | 15/194 |
| 3,819,779 | A | | 6/1974 | Pharris et al. | |
| 3,831,218 | A | | 8/1974 | Kaplan | |
| 4,751,762 | A | | 6/1988 | Meimeteas | |
| 5,800,751 | A | | 9/1998 | Barker | |
| 6,195,830 | B1 | * | 3/2001 | Bruschi | 15/143.1 |

FOREIGN PATENT DOCUMENTS

| | | | | |
|---|---|---|---|---|
| DE | 28 52 367 | | 6/1980 | |
| FR | 1211201 | * | 3/1960 | 15/193 |
| GB | 1074917 | * | 7/1967 | 15/193 |
| IT | 661896 | * | 3/1964 | 15/193 |

* cited by examiner

*Primary Examiner*—Gary K. Graham
(74) *Attorney, Agent, or Firm*—Renner, Otto, Boisselle & Sklar, LLP

(57) ABSTRACT

A paint brush includes a two component brush handle having a head portion made of a relatively rigid plastic material and a grip portion made of a relatively soft, flexible elastomeric material. The head portion has one end adapted to fit within the ferrule of a brush and an other end having an integral web portion protruding axially outwardly therefrom about which the grip portion is over molded to secure the grip portion to the head portion. One or more openings are provided in the web portion through which the material of the grip portion is caused to extend during the over molding step to provide a mechanical connection between the grip portion and head portion.

32 Claims, 2 Drawing Sheets

PAINT BRUSH WITH TWO COMPONENT BRUSH HANDLE AND METHOD OF MAKING SAME

FIELD OF THE INVENTION

This invention relates to a paint brush including a handle having a head portion made of a relatively rigid plastic material and a grip portion made of a relatively soft, flexible elastomeric material and to the method of making same.

BACKGROUND OF THE INVENTION

It is generally known to provide paint brushes with handles that have an outer layer of a relatively soft, resilient elastomeric material such as thermoplastic rubber that is comfortable to the grip and an inner core of a relatively rigid thermoplastic material that securely retains suitable fasteners used to attach the brush ferrules to such handles. However, such rigid cores will not allow the handles to flex to conform to a variety of hand shapes and sizes.

The desired flexibility can be obtained by making the paint brush handles substantially entirely out of a relatively soft, resilient elastomeric material. However, that makes it difficult to securely attach the handles to the brush ferrules using conventional fastening techniques.

Also, most paint brush handles are too rigid and too long to be maneuverable for painting corners and tight spaces and the like.

The paint brush of the present invention overcomes these and other disadvantages of previously known paint brushes.

SUMMARY OF THE INVENTION

In accordance with one aspect of the invention, a paint brush handle is provided with a head portion that is made of a relatively rigid plastic material having one end adapted to be fitted within the ferrule of a brush and an other end having an integral web portion protruding axially outwardly therefrom about which a grip portion made of a relatively soft, flexible elastomeric material is molded to secure the grip portion to the head portion.

In accordance with another aspect of the invention, the grip portion is made of a thermoplastic material that is compatible with the thermoplastic material of the head portion to form a chemical bond with the head portion including particularly the web portion when the grip portion is molded around the web portion.

In accordance with another aspect of the invention, one or more openings are provided in the web portion through which the material of the grip portion extends to provide a mechanical connection between the head portion and grip portion.

In accordance with another aspect of the invention, the other end of the head portion has a transverse end wall from which the web portion extends that serves as a seal-off for the grip portion during over molding of the grip portion around the web portion.

In accordance with another aspect of the invention, the transverse end wall has two substantially flat wall portions that slope away from each other from the approximate center of the end wall to opposite sides of the head portion to serve as a seal-off for the grip portion and make up for any variations in thickness of the head portion during such over molding of the grip portion around the web portion.

In accordance with another aspect of the invention, a raised band extends around the periphery of the other end of the head portion to provide a stop and transition point for the brush ferrule.

In accordance with another aspect of the invention, pockets are provided in opposite sides of the head portion to reduce the thickness of the head portion to provide more even cooling of the head portion during molding of the head portion.

In accordance with another aspect of the invention, a cross web extends transversely through the approximate center of the pockets to provide additional support for the brush ferrule when one end of the head portion is fitted within the brush ferrule.

In accordance with another aspect of the invention, the head portion includes land areas at opposite ends of the pockets for receipt of fasteners used to secure the brush ferrule to the head portion.

In accordance with another aspect of the invention, the land areas may have slots into which portions of the brush ferrule may be crimped for securing the brush ferrule to the head portion.

In accordance with another aspect of the invention, the grip portion is desirably approximately two to three inches long to make the brush a more maneuverable size for painting corners and tight spaces and the like.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
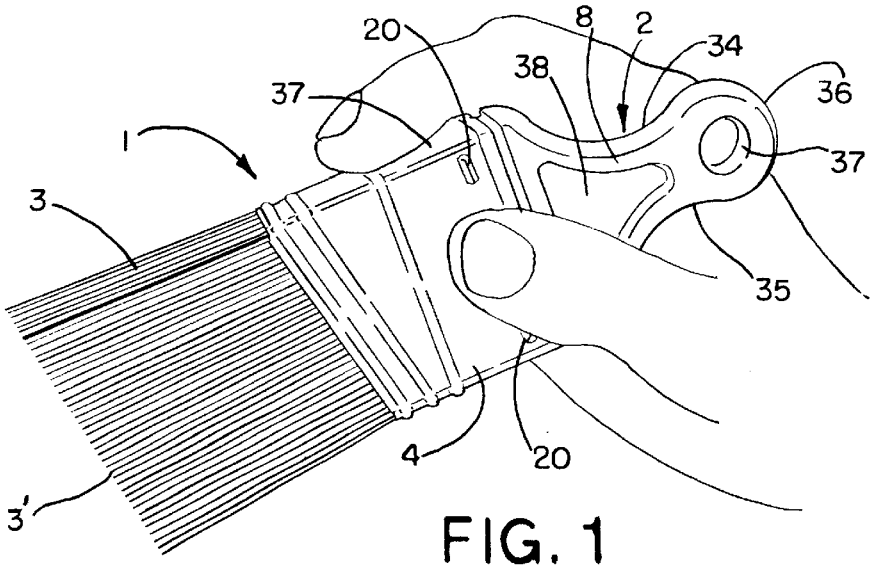
FIG. 1 is a schematic perspective view of a preferred form of paint brush in accordance with the present invention shown being held in one of a variety of ways in a user's hand.

A preferred form of paint brush 1 in accordance with this invention is schematically illustrated in FIG. 1, and comprises a handle 2, bristles or filaments 3 and a metal ferrule 4 for connecting the filaments to the handle 2. As is conventional, the filaments 3 are set in a suitable adhesive 5 such as an epoxy that extends into one or more outwardly protruding annular grooves 6 in the inner wall of the ferrule 4 for securely fastening the filaments to the ferrule as schematically shown in FIGS. 3 and 4.

In the embodiment disclosed herein, the outer ends 3' of the filaments 3 are progressively longer across the width of the brush to provide an angled brush such as typically used for trim work. However, it will be appreciated that the outer ends of the filaments may all be of substantially the same length if desired.

Figure 3:
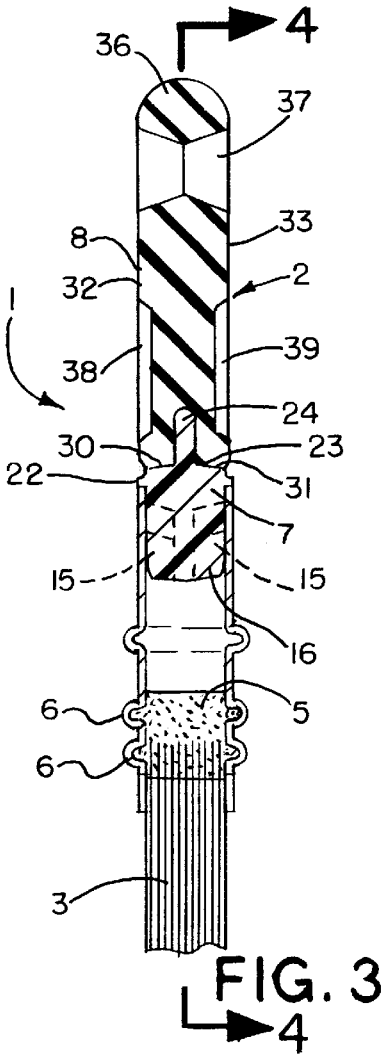
FIG. 3 is a fragmentary longitudinal section through the brush of FIG. 2 taken generally along the plane of the line 3—3 thereof.
Figure 4:
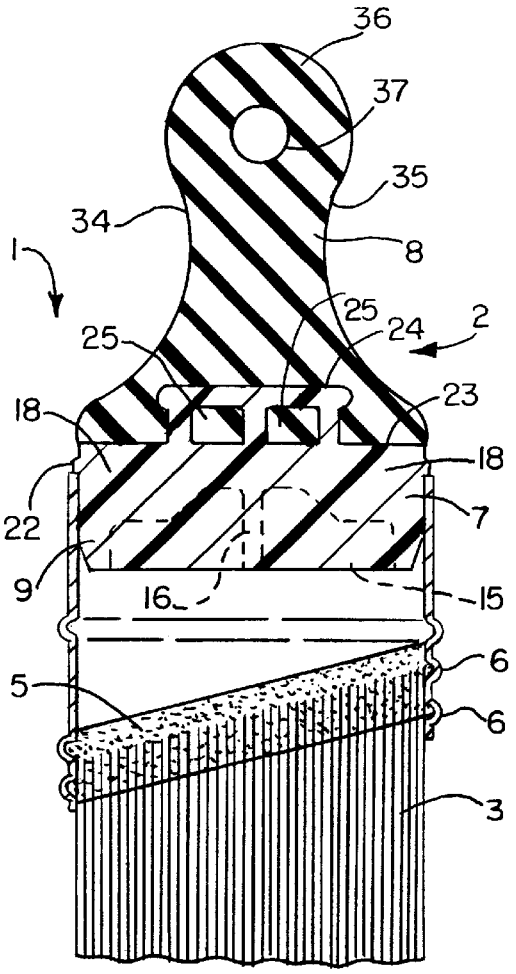
FIG. 4 is a fragmentary longitudinal section through the brush of FIG. 3 taken generally along the plane of the line 4—4.

The handle 2 consists of two main components, a head portion 7 (shown by itself in FIG. 5) and a grip portion 8 (see FIGS. 3 and 4). The head portion 7 is pre-molded out of a relatively rigid plastic such as polypropylene that is impervious to most paint solvents. The lower end 9 of the head portion 7 is shaped to provide a close fit within the upper end of the metal ferrule 4. On opposite sides of the head portion 7 intermediate the width thereof are pockets 15 which reduce the thickness of the head portion to provide more even cooling of the head portion during injection molding of the head portion. Extending transversely through the center of each pocket 15 is a cross web 16 that provides additional support for the brush ferrule 4 when the head portion 7 is fitted within the brush ferrule (see FIG. 3).

Figure 2:
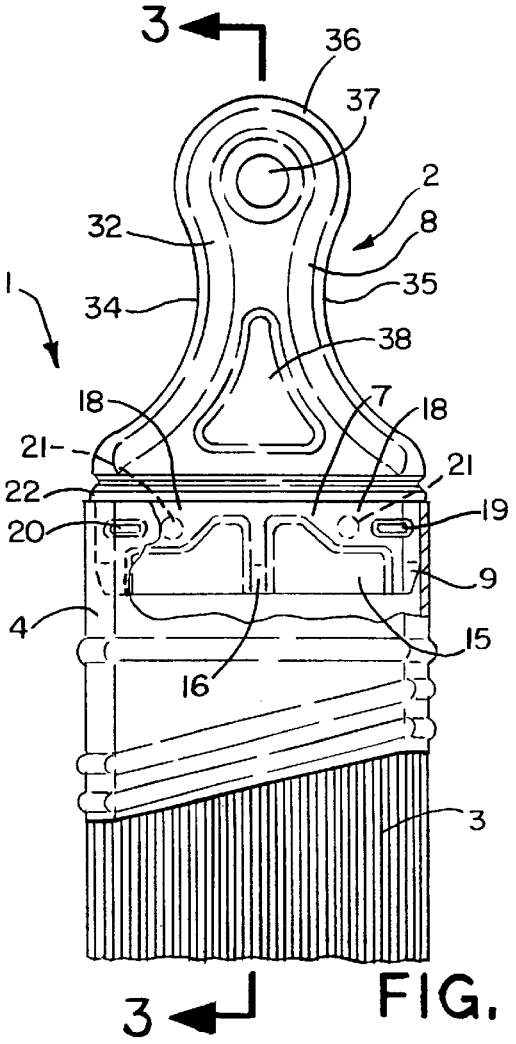
FIG. 2 is an enlarged fragmentary side elevation view of the brush of FIG. 1.

At opposite ends of the pockets 15 on each side of the head portion 7 are land areas 18 each containing a crimp slot 19 to allow portions 20 of the ferrule 4 to be crimped into the slots (see FIG. 1) for securing the ferrule to the head portion. Alternatively, if desired suitable fasteners such as nails 21 may be driven through the ferrule into the land areas 18 next to the crimp slots 19 to securely attach the brush ferrule to the head portion without the need for crimping the ferrule into the crimp slots. Of course, other fasteners could be used besides nails, such as screws, staples, rivets or the like. The fasteners 21 securely hold the ferrule 4 in place by penetrating the land areas 18. Two such fasteners 21 are schematically shown in phantom lines in FIG. 2.

Extending around the periphery of the upper end of the head portion 7 is a raised band 22 to provide a stop and transition point for the ferrule 4 when the lower end of the head portion is fitted within the ferrule as shown in FIGS. 3 and 4.

At the uppermost end of the head portion 7 is a transverse end wall 23 having an integral web portion 24 protruding axially outwardly/upwardly from the axial center of the transverse end wall about which the inner end of the grip portion 8 is over molded to secure the grip portion to the head portion with the grip portion extending axially outwardly of the web portion as shown in FIGS. 3 and 4. The thickness of the web portion 24 is less than the thickness of the uppermost end of the head portion 7 as further shown in FIGS. 3 and 4. The thermoplastic material of the grip portion 8 is desirably compatible with the thermoplastic material of the head portion 7, whereby during the over molding operation, the grip portion forms a chemical bond with the web portion 24 and transverse end wall 23 of the head portion. Also, one or more openings 25 (two being shown) are provided in the web portion 24 through which the material of the grip portion 8 is molded during the over molding operation to provide a mechanical connection between the head portion and grip portion.

Figure 5:
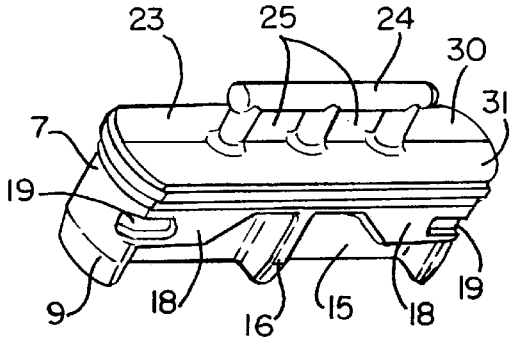
FIG. 5 is an enlarged perspective view of the head portion of the brush handle of FIGS. 1 through 4.

Preferably, the transverse end wall 23 of the head portion 7 has two substantially flat wall portions 30, 31 that slope downwardly away from each other from the approximate axial center of the end wall to opposite sides of the head portion (see FIGS. 3 and 5). These wall portions 30, 31 serve as a seal-off for the grip portion 8 and make up for any variations in thickness of the head portion 7 during the over mold operation. Upon closing the over mold, the seal-off areas of the flat wall portions 30, 31 are compressed slightly to prevent the grip material from flowing past the transverse end wall 23.

In the preferred embodiment disclosed herein, the grip portion 8 desirably has an overall length of approximately two to three inches and substantially flat opposite sides 32, 33 and concave opposite edges 34, 35 that terminate in a rounded outer end 36. Such an overall shape allows the grip portion 8 to be held in a variety of ways including the way shown in FIG. 1 in which the thumb and middle finger of the user's hand engage opposite sides of the ferrule and the index finger rests on the upper edge 37 of the ferrule and the rounded outer end 36 of the grip portion rests in the crease between the thumb and index finger. Gripping the brush this way provides added control and maneuverability of the brush which is particularly advantageous when painting corners and tight spaces and the like.

Also, providing the brush handle with such a relatively short grip portion 8 allows the grip portion to fit in the palm of the user's hand when the ferrule is gripped between the thumb and middle finger and the index finger is placed on the top edge of the ferrule. However, it will be appreciated that the grip portion could be made longer, for example, up to six inches, and still provide greater control and maneuverability of the brush due to the increased flexibility of the grip portion.

A hole 37 may be provided in the outer end 36 of the grip portion 8 to allow the brush to be hung from a wire hanger or the like. Also, triangular shaped pockets 38, 39 may be provided in opposite sides 32, 33 of the grip portion 8 for decorative purposes and to aid slightly in cooling of the grip portion during the over molding operation.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A paint brush handle comprising a head portion made of a substantially rigid plastic material and a grip portion made of a flexible elastomeric material, said head portion having one end shaped to provide a close fit within a ferrule of a brush and an other end having an integral web portion protruding axially outwardly from said other end, said web portion having a thickness less than the thickness of said other end of said head portion, said grip portion having an inner end molded around said web portion thereby securing said grip portion to said head portion, said grip portion extending axially outwardly of said web portion.

2. The handle of claim 1 wherein said web portion has at least one opening through which the material of said grip portion extends to provide a mechanical connection between said head portion and said grip portion.

3. The handle of claim 1 wherein said web portion has a plurality of openings through which the material of said grip portion extends to provide a mechanical connection between said head portion and said grip portion.

4. The handle of claim 1 wherein said other end of said head portion has a transverse end wall from which said web portion extends that serves as a seal-off for said grip portion during such molding of said grip portion around said web portion.

5. The handle of claim 1 wherein said grip portion is made of a thermoplastic material that forms a chemical bond with said web portion when said grip portion is molded around said web portion.

6. The handle of claim 5 wherein said head portion is made of polypropylene and said grip portion is made of a thermoplastic elastomer.

7. The handle of claim 1 wherein said grip portion is approximately two to three inches long.

8. A paint brush comprising a ferrule, brush filaments secured within said ferrule, and a handle comprising a head portion made of a substantially rigid plastic material and a grip portion made of a flexible elastomeric material, said head portion having one end shaped to provide a close fit in said ferrule, said one end being secured within said ferrule, and an other end having an axially outwardly protruding web portion about which an inner end of said grip portion is over molded to secure said grip portion to said head portion, said web portion having a thickness less than the thickness of said other end of said head portion, said grip portion extending axially outwardly of said web portion.

9. The brush of claim 8 wherein said web portion includes one or more openings through which the material of said grip portion extends to provide a mechanical connection between said grip portion and said head portion.

10. The brush of claim 9 wherein said other end of said head portion has one or more flat regions which serve as a seal-off for said grip portion during such over molding of said grip portion around said protruding portion.

11. The brush of claim 8 wherein said grip portion is approximately two to three inches long.

12. A method of making a paint brush handle comprising the steps of premolding a head portion out of a substantially rigid plastic material having one end formed to provide a close fit within a ferrule of a brush and an other end formed with an axially outwardly protruding web portion having a thickness less than the thickness of the other end, and over molding an inner end of a grip portion made of a flexible elastomeric material around the protruding web portion to secure the grip portion to the head portion with the grip portion extending axially outwardly of the web portion.

13. The method of claim 12 wherein the protruding web portion includes one or more openings through which the material of the grip portion is caused to extend during the over molding step to provide a mechanical connection between the grip portion and the head portion.

14. The method of claim 12 wherein the outer end of the head portion has a transverse end wall from which the protruding web portion extends, and one or more flat regions are provided on the transverse end wall that serve as a seal-off for the grip portion during such over molding step.

15. The method of claim 12 wherein the head portion is made of polypropylene and the grip portion is of a thermoplastic elastomer.

16. A paint brush handle comprising a head portion made of a substantially rigid plastic material and a grip portion made of a flexible elastomeric material, said head portion having one end adapted to be fitted within a ferrule of a brush and an other end having an integral web portion protruding axially outwardly from said other end, said grip portion being molded around said web portion thereby securing said grip portion to said head portion, said other end of said head portion having a transverse end wall from which said web portion extends that serves as a seal-off for said grip portion during such molding of said grip portion around said web portion, said transverse end wall having two substantially flat wall portions that slope away from each other from the approximate center of said end wall to opposite sides of said head portion that serve as a seal-off for said grip portion and make up for any variations in thickness of said head portion during such molding of said grip portion around said web portion.

17. A paint brush handle comprising a head portion made of a substantially rigid plastic material and a grip portion made of a flexible elastomeric material, said head portion having one end adapted to be fitted within a ferrule of a brush and an other end having an integral web portion protruding axially outwardly from said other end, said grip portion being molded around said web portion thereby securing said grip portion to said head portion, and a raised band around the periphery of said other end of said head portion that acts as a stop and transition point for the brush ferrule when said one end of said head portion is fitted within the brush ferrule.

18. The handle of claim 17 wherein said head portion has at least one slot on opposite sides into which portions of the brush ferrule are adapted to be crimped for securing the brush ferrule to said head portion.

19. The handle of claim 17 wherein said head portion has land areas on opposite sides for receipt of fasteners for securing the brush ferrule to said head portion.

20. A paint brush handle comprising a head portion made of a substantially rigid plastic material and a grip portion made of a flexible elastomeric material, said head portion having one end adapted to be fitted within a ferrule of a brush and an other end having an integral web portion protruding axially outwardly from said other end, said grip portion being molded around said web portion thereby securing said grip portion to said head portion, said head portion having pockets in opposite sides intermediate the width of said sides to reduce the thickness of said head portion to provide more even cooling of said head portion during molding of said head portion.

21. The handle of claim 20 further comprising a cross web extending transversely through the approximate center of said pockets to provide additional support for the brush ferrule when said one end of said head portion is fitted within the brush ferrule.

22. The handle of claim 20 wherein said head portion includes land areas adjacent opposite ends of said pockets for receipt of fasteners for securing the brush ferrule to said head portion.

23. The handle of claim 22 wherein said land areas have slots into which portions of the brush ferrule are adapted to be crimped for securing the brush ferrule to said head portion.

24. A paint brush comprising a ferrule, brush filaments secured within said ferrule, and a handle comprising a head portion made of a substantially rigid plastic material and a grip portion made of a flexible elastomeric material, said head portion having one end secured within said ferrule, and an other end having an axially outwardly protruding web portion about which said grip portion is over molded to secure said grip portion to said head portion, said one end of said head portion being shaped to provide a close fit within said ferrule, and said other end of said head portion having a raised band extending around the periphery of said other end to provide a stop and transition point for said ferrule.

25. The brush of claim 24 wherein said head portion has slots in opposite sides into which portions of said ferrule are crimped to secure said ferrule to said head portion.

26. The brush of claim 24 wherein said head portion has land areas on opposite sides, and fasteners extend through said ferrule into said land areas for securing said ferrule to said head portion.

27. The brush of claim 20 wherein said head portion has pockets in opposite sides intermediate the width of said sides to reduce the thickness of said head portion, and a cross web extends through the transverse center of said pockets to provide additional support for said ferrule in the region of said pockets.

28. A method of making a paint brush handle comprising the steps of premolding a head portion out of a substantially rigid plastic material having one end formed to be fitted within a ferrule of a brush and an other end formed with an axially outwardly protruding web portion and a raised band extending around the periphery of the other end to provide a stop and transition point for the ferrule, and over molding a grip portion made of a flexible elastomeric material around the protruding web portion to secure the grip portion to the head portion.

29. A method of making a paint brush handle comprising the steps of premolding a head portion out of a substantially rigid plastic material having one end formed to be fitted within a ferrule of a brush and an other end formed with an axially outwardly protruding web portion, and pockets formed in opposite sides of the head portion to reduce the thickness of the head portion in the region of the pockets to provide more even cooling of the head portion during the premolding step, and over molding a grip portion made of a flexible elastomeric material around the protruding web portion to secure the grip portion to the head portion.

30. The method of claim 29 wherein a cross web is molded through the transverse center of the pockets during the premolding step to provide additional support for the ferrule.

31. The method of claim 30 wherein land areas are formed at opposite ends of the pockets during the premolding step for receipt of fasteners used to secure the ferrule to the head portion.

32. The method of claim 30 wherein land areas are formed at opposite ends of the pockets and slots are formed in the land areas during the premolding step into which portions of the ferrule are adapted to be crimped for securing the ferrule to the head portion.

* * * * *